US011090704B2

(12) United States Patent
Sapnu

(10) Patent No.: US 11,090,704 B2
(45) Date of Patent: Aug. 17, 2021

(54) DENT PULLER WITH OPPOSED LEVER AND GRIPPING SURFACE

(71) Applicant: Rey Sapnu, Orland Park, IL (US)

(72) Inventor: Rey Sapnu, Orland Park, IL (US)

( * ) Notice: Subject to any disclaimer, the term of this patent is extended or adjusted under 35 U.S.C. 154(b) by 137 days.

(21) Appl. No.: 16/543,552

(22) Filed: Aug. 17, 2019

(65) Prior Publication Data

US 2021/0046530 A1 Feb. 18, 2021

(51) Int. Cl.
*B21D 1/06* (2006.01)

(52) U.S. Cl.
CPC ..... *B21D 1/06* (2013.01)

(58) Field of Classification Search
CPC .... B21D 1/00; B21D 1/06; B21D 1/12; Y10S 72/705
See application file for complete search history.

(56) References Cited

U.S. PATENT DOCUMENTS 3,891,187 A * 6/1975 Bearden, Jr. ..... A62B 3/005 254/93 R
4,073,181 A * 2/1978 Steinmann, Jr. ..... B21D 1/06 72/479
8,516,875 B1 8/2013 Chan
10,099,269 B1 * 10/2018 Lin ..... B21D 1/12

FOREIGN PATENT DOCUMENTS

DE 102013111755 B3 * 12/2014 ..... B21D 1/12

* cited by examiner

*Primary Examiner* — Teresa M Ekiert
(74) *Attorney, Agent, or Firm* — Moreno IP Law LLC

(57) ABSTRACT

A dent puller tool comprises a base for supporting the tool on a working surface, the base having a first bore defined therein. A grip body is provided in cooperative associating with the base and defining a gripping surface and a second bore extending therethrough. A puller shaft is disposed in the first and second bores and substantially parallel to the gripping surface. A lever is cooperatively associated with the puller shaft and pivotably mounted relative to the grip body such that the gripping surface and the lever extend along opposite sides of the puller shaft. Configured in this manner, the disclosed tool helps avoid undesirable bending of the user's wrist when in use.

13 Claims, 5 Drawing Sheets

DENT PULLER WITH OPPOSED LEVER AND GRIPPING SURFACE

FIELD

The present disclosure concerns a dent puller and, in particular, a dent puller having a lever and gripping surface on opposite sides of a puller shaft.

BACKGROUND

Dent pullers or lifters are a class of devices that permits dent or other deformations of a material (most typically, sheet metal) to be repaired. A particular type of dent puller are so-called mini-pullers or mini-lifters, a typical example of which is illustrated in U.S. Pat. No. 8,516,875 issued to Chan.

As best shown in FIG. 3 of the '875 patent (and using the reference numerals illustrated therein), such mini-pullers typically comprise a body 10 having a substantially vertical bore 11 extending therethrough with a shaft 20 aligned therein. Legs 90 extend from the body 10 such that the shaft 20 may be positioned above and in alignment with a dent to be repaired. An end of the shaft 20 is equipped with a puller 40 that may be coupled to a pull piece 50 that, in turn, is configured to be attached to surface to be repaired. As further shown in the '875 patent, the body 10 has a handle 70 extending therefrom substantially perpendicular to longitudinal axis of the shaft 20. A pull bar or lever 60 is also pivotably mounted on the body such that it engages with the shaft 20, which lever 60 is also substantially aligned with the handle 70 such that a user can grasp both the lever 60 and handle 70 with a single hand. By applying a squeezing force on the lever 60 and handle 70, the lever 60 is rotated toward the handle 70, thereby also inducing upward linear movement of the shaft 20. If the mechanical advantage provided by the lever 60 is relatively high, a correspondingly substantial amount of force may be transferred through the shaft 20. If sufficient force is applied to the lever 60, the force of the upward movement of the shaft 20 may likewise be sufficient to "pull" the dent out of the surface to be repaired, i.e., the material is once again deformed to more closely match its original configuration.

Devices such as that disclosed in the '875 patent have proven particular useful in the field of automotive dent repairs for the purpose of removing relatively small dents from sheet metal surfaces. A shortcoming of such devices, however, results from the alignment of the handle 70 and lever 60 substantially perpendicular to the shaft 20. Configured in this manner, the user is often forced to bend his/her wrist through ulnar deviation or flexion, i.e., bending the wrist in a direction toward the little finger. However, repetitive and forceful movement of the wrist in this manner presents the risk of damage to the user's wrists.

FIG. 1 provides a schematic illustration of another prior art device commercially known as the Keco K1911 Ratcheting Robo Mini Lifter or Dent Gun. As shown, the device comprises a housing having a shape similar to a handgun and defining a grip surface on a handle 104 extending at an angle from a main body 102 of the housing. A lever 106 is pivotably mounted on the housing via a pivot 108 in a manner similar to a handgun trigger, i.e., such that the handle 104 and lever 106 are graspable by a user's single hand. A beam 110 is attached to the housing via another pivot 112 at one end of the beam, with the other end of the beam 111 configure to engage a contact surface 109 of the lever 106. A shaft 116 is also provided within a bore formed in the main body 102 of the housing, such that the shaft 116 is approximately parallel with handle 104 and lever 106. The beam 110 engages the shaft 116 through a retainer 118 attached to the shaft 116. As further shown in FIG. 1, a base 114 may be coupled to the main body 102 in such that the shaft 116 passes through a bore also formed in the base 114. A distal end of the shaft, i.e., opposite an end where the beam 110 engages the shaft 116/retainer 118, is provided with a puller 120 that may be attached to pulling tabs, as known in the art. A spring 112 is also provided between the puller 120 and a surface of the main body 102 such that the shaft 116 is biased downward as shown in FIG. 1. This biasing force, in turn, biases the beam 110 into contact with the contact surface 109 of the lever 106.

By applying a pulling force 130 to the lever 106, the contact surface 109 induces upward rotation of the beam 110. In turn, the upward rotation of the beam 110 induces upward, linear motion 132 of the shaft 116. In essence, then, the device illustrated in FIG. 1 splits the lever 60 from the '875 patent into two components (the lever 106 and beam 110) such that the lever 106 illustrated in instant FIG. 1 can be aligned in a direction that is approximately parallel to the longitudinal axis of the shaft 116. In so doing, the above-noted shortcoming of the device disclosed in the '875 patent, i.e., the need to bend the user's wrist, may be substantially eliminated. However, by placing both the handle 104 and lever 106 to one side of the shaft 116, overall control of the device is somewhat more complex.

Thus, it would be advantageous to provide a dent puller tool that substantially eliminates the shortcomings of prior art devices.

SUMMARY

The instant disclosure describes a tool comprising a base for supporting the tool on a working surface, the base having a first bore defined therein. A grip body is provided in cooperative associating with the base and defining a gripping surface and a second bore extending therethrough. A puller shaft is disposed in the first and second bores and substantially parallel to the gripping surface. A lever is cooperatively associated with the puller shaft and pivotably mounted relative to the grip body such that the gripping surface and the lever extend along opposite sides of the puller shaft. In an embodiment, the lever may be pivotably mounted on the grip body. In another embodiment, the second bore extends substantially parallel to a longitudinal axis of the grip body. The grip body may be mounted on the base such that the longitudinal axis of the grip body is substantially perpendicular to the base. Further, the grip body may be mounted on the base for pivoting movement about the second bore formed in the grip body. A set screw may be provided in cooperative association with the base and configured to engage the grip body. A puller may be mounted on an end of the puller shaft, for example, through a threaded engagement. The lever may comprise an opening therein, with the shaft passing therethrough. The lever and grip body may be dimensioned, and the lever mounted to the grip body, such that both the lever and grip body may be simultaneously grasped by a single hand. The base may comprise a central member having the first bore formed therein and at least one leg extending therefrom. In turn, the at least one leg may have at least one foot, configured to engage the working surface, cooperatively associate therewith. The at least one foot may be pivotably mounted on the at least one leg and, further, each of the at least one foot may comprise a compliant material defining a surface for engaging the working surface.

BRIEF DESCRIPTION OF THE DRAWINGS

The features described in this disclosure are set forth with particularity in the appended claims. These features and attendant advantages will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

Unless stated otherwise, "substantially" as used herein refers to relationships between elements within reasonable manufacturing tolerances.

Figure 1:
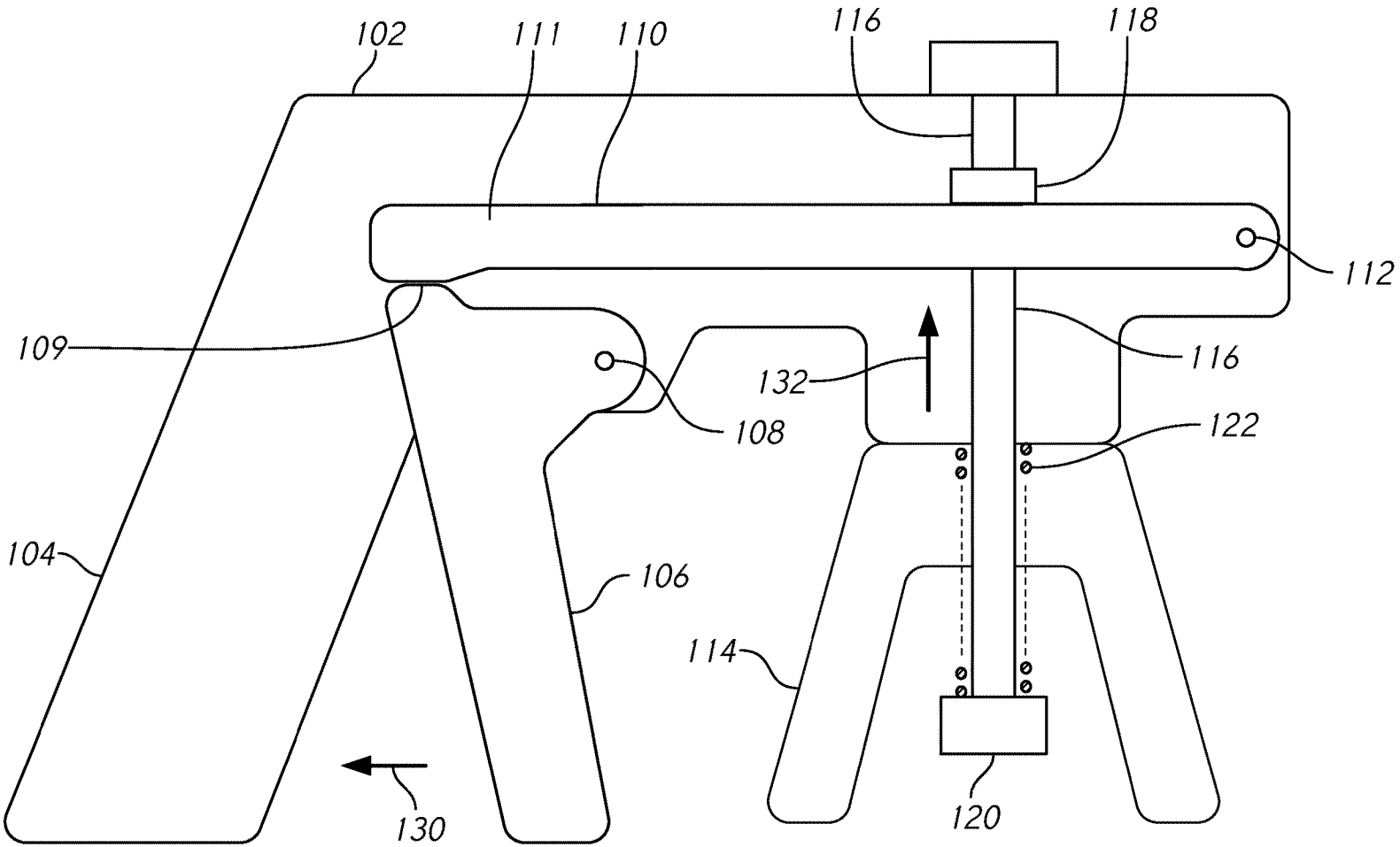
FIG. 1 (Prior Art)
FIG. 1 is a schematic illustration of a device in accordance with prior art teachings.
Figure 2:
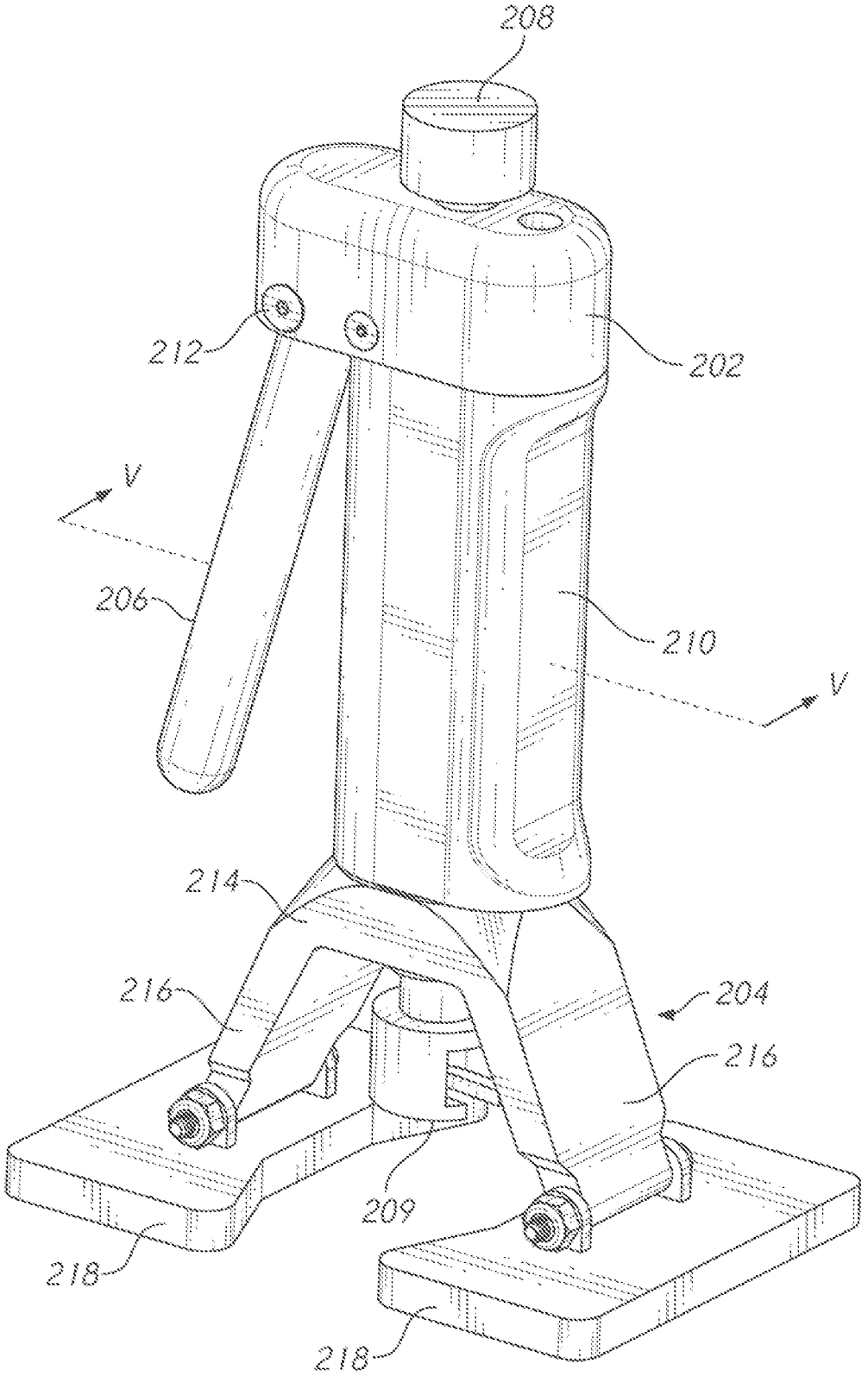
FIG. 2 illustrates a front and side perspective view of a tool in accordance with the teachings of instant disclosure.
Figure 3:
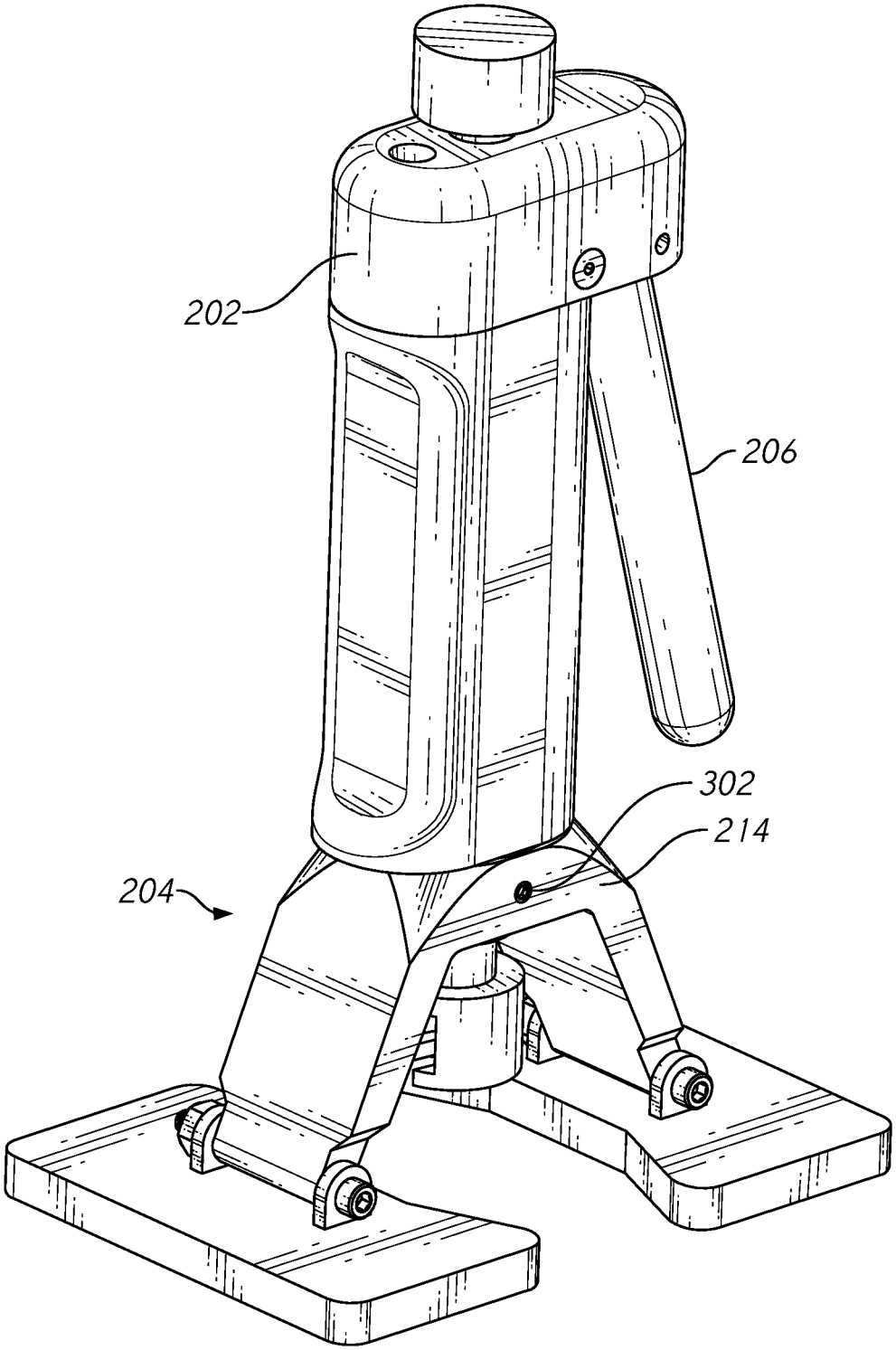
FIG. 3 illustrates a back and side perspective view of the tool of FIG. 1.
Figure 5:
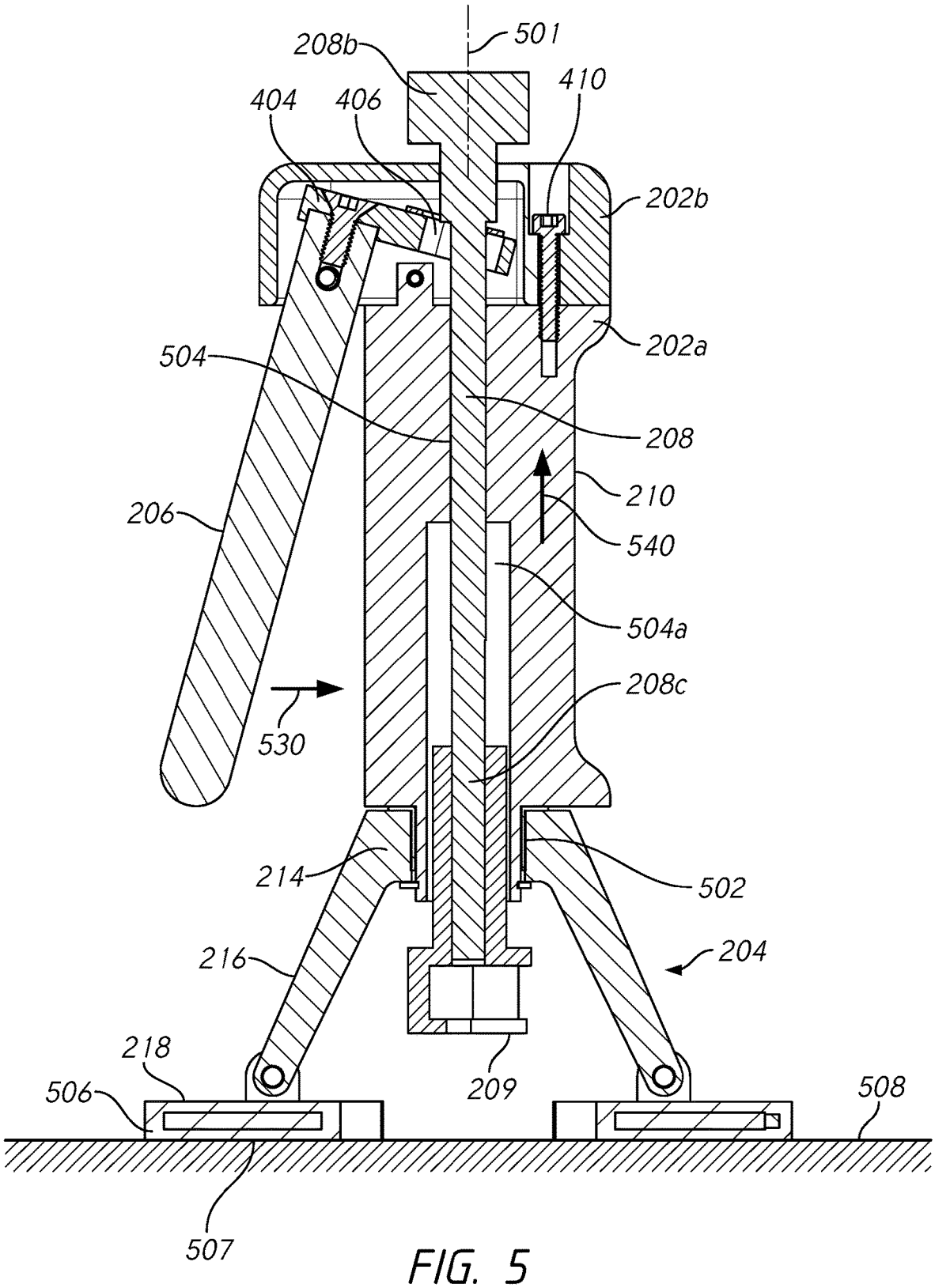
FIG. 5 illustrates a cross-sectional view of the tool of FIG. 1 taken along section plane V-V.

Referring now to FIGS. 2, 3 and 5, a tool 200 in accordance with the instant disclosure is shown. In particular, the tool 200 comprises a grip body 202 cooperatively associated with a base 204. The base 204 defines a first bore 502 and the grip body 202 defines a second bore 504 that is substantially parallel to a longitudinal axis 501 of the grip body. A lever 206 is cooperatively associated with a puller shaft 208 that extends through the first and second bores 502, 504, and is further mounted for pivoting movement relative to the grip body 202.

As described in greater detail below, rotation of the lever 206 induces linear movement of the puller shaft 208. The grip body 202 further defines a gripping surface 210 that is substantially parallel to the second bore 504 formed in the grip body 202. As illustrated in FIGS. 2, 3 and 5, the lever 206 is mounted relative to the grip body 202 such that the lever 206 and gripping surface 210 extend along opposite sides of the puller shaft 208. In an embodiment, "opposite" means that the lever 206 and gripping surface 210 are substantially diametric, i.e., such that a plane in which the lever 206 rotates intersects both the puller shaft 208 and the gripping surface 210. However, it is understood that "opposite" as used herein may include positioning deviating from diametric by up to as much as 20 degrees. By positioning the lever 206 opposite the gripping surface 210 in the manner, a user is able to grasp the tool in a way that does not require bending of the user's wrist, thereby avoiding potential discomfort or injury.

Further, in an embodiment, the lever 206 and gripping surface 210 are dimensioned, and the lever 206 is mounted relative to the grip body 202, such that the lever 206 and gripping surface 210 may be simultaneously grasped with a single hand. For example, as shown in the Figures (i.e., with the lever 206 positioned at its farthest position away from the grip body 202), a most distal point of the lever 206 relative to the gripping surface 210 is no more than approximately six inches (15.2 centimeters) away from the gripping surface 210, and is preferably within the range of approximately 3-4 inches (7.6-10.2 centimeters) away from the gripping surface 210.

As shown, the base 204 may comprise a central member 214 having the first bore 502 formed therein. As best shown in FIG. 5, the grip body 202 (specifically the lower grip body 202*a* as shown in FIG. 5) may have a reduced diameter portion that extends into the first bore 502 of the base 204 such that the grip body 202 is mounted on the base 204 and also rotatable about the second bore 504 relative to the base 204. As further shown in FIG. 5, the first and second bores 502, 504 are concentric about the longitudinal axis 501 of the grip body 202. However, this is not a requirement as the first and second bores 502, 504 could be concentric but not aligned with the longitudinal axis 501, i.e., the second bore 504 could be formed off-axis but still parallel to the longitudinal axis 501. Regardless, rotation of the grip body 202 relative to the base 204 may be prevented through the use of set screw 302 extending through a portion of the base 302 such that the set screw 302 intersects with first bore 502 and into engagement with an outer surface of the reduced-diameter portion of the grip body 202.

The base 204 may further comprise one or more legs 216 (two shown) extending away from the central member 214 at an angle. Further, each leg 216 may terminate in a corresponding foot 218. In a preferred embodiment, each foot 218 preferably provides a relatively broad and flat surface, and is rotatably mounted on the corresponding leg 216 via suitable fasteners. Further still, and with reference to FIG. 5, each of the feet 218 may comprise a compliant material 506, such as foam rubber or like, attached to a surface thereof such that the compliant material 506 defines a further surface 507 for engaging a working surface 508 upon the base 204 rests when in use.

Figure 4:
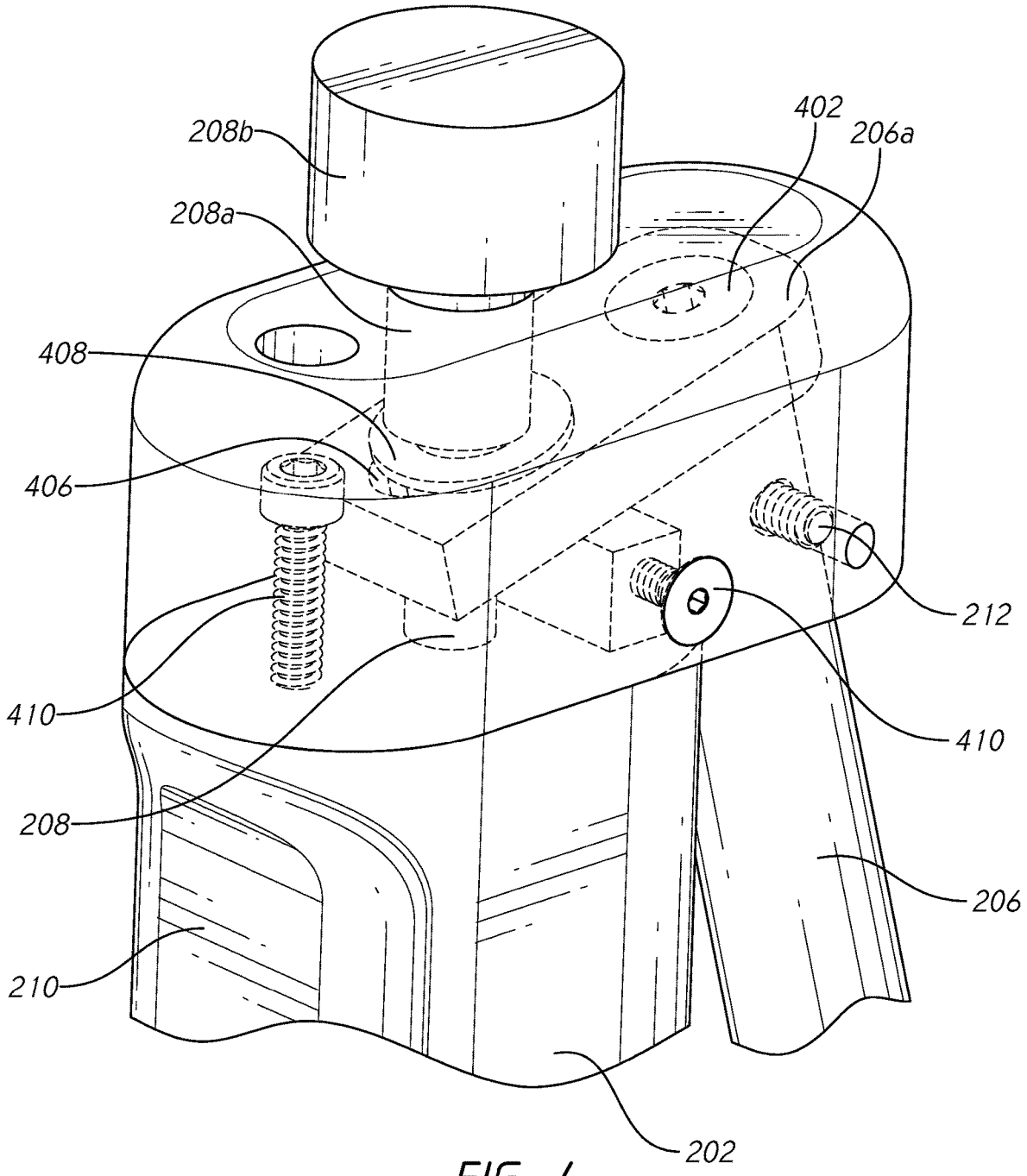
FIG. 4 illustrates a partially disassembled and detailed view of the tool of FIG. 1, particularly the cooperative association of a lever and puller shaft in accordance with the teachings of the instant disclosure.

In an embodiment, the grip body 202 comprises and upper and lower grip body 202*a*, 202*b* as best illustrated in FIG. 5, though this is not a requirement as the grip body 202 may comprise a greater or lesser number of parts. As shown in FIGS. 4 and 5, the upper grip body 202*b* may be secured to the lower grip body 202*a* via suitable fasteners 410. As best shown in FIGS. 2 and 4, the lever 206 may be pivotably mounted on the grip body via a pivot 212 that, in turn, is mounted on the upper grip body 202*b*.

Referring to FIG. 4, the lever 206 and its engagement with the puller shaft 208 are illustrated in further detail. In this illustration, the upper grip body 202*b* is illustrated in phantom. In this embodiment, an upper end of the lever 206 is attached to a plate 206*a* via a suitable fastener 402 such that the lever 206 and plate 206*a* operate as a unit. It is appreciated that the plate 206*a* could instead be integrally formed with the lever 206. Regardless, the plate 206*a* defines an opening 406. Preferably, the opening 406 is a slot having a width that is slightly larger than a diameter of the shaft 208, but not larger than a diameter of an increased-diameter portion 208*a* of the shaft. As shown, the shaft 208 extends through the opening 406 and into the second bore 504. Given the width of the opening 208*a*, the shaft 208 is relatively loosely maintained within the opening 208*a*. As further shown, a washer 408 may be placed on the shaft 208 interposed between the plate 206*a* and the increased-diameter portion 208*a*. However, the increased-diameter portion 208*a* acts as a shoulder such that rotation of the plate 206*a* upward (as shown in the Figure) will cause the plate 206*a* (and the washer 408) to engage the increased-diameter portion 208*a* thereby inducing upward, linear movement of the shaft 208. Assuming the length of the lever 206 is significantly longer than the effective arm length resulting from the engagement of the plate 206*a* with the increased-diameter portion 208*a*, a mechanical advantage is realized such that the squeezing force applied by a user of the tool 200 is increased proportionately. While the embodiment shown in the Figures illustrates the lever 206 being pivotably mounted on the grip body 202, it is appreciated that this is not necessarily a requirement; only that the lever arm 206 be pivotably mounted relative to the grip body 202.

As best illustrated in FIG. 5, a distal end of the shaft 208 (i.e., an end proximate to the base 204) may have a puller 209 mounted thereon. In an embodiment, the second bore 504 comprises an increased-diameter portion 504*a* that permits at least a portion of the body of the puller 209 to slidably extend into the second bore 504. As known in the art, the puller 209 is configured to engage puller tabs that may be glued to the working surface such that linear motion of the shaft 208*a* (and, therefore, the puller 209) will apply a pulling force on the puller tab, thereby reversing the deformation of the working surface. In a preferred embodiment, the shaft 208 comprises a threaded portion 208*c* at its distal end that matingly engages a corresponding threaded portion of the puller 209. Further, the puller shaft 208 also includes a knob portion 208*b* such that the shaft 208 may be rotated, thereby adjusting the distance that the shaft 208 is screwed into the puller 209. In this manner, the height of the puller 209 above the working surface 508 may be adjusted to best engage the puller tab.

In an embodiment, when the tool 200 is not in use, the combined mass of the puller shaft 208 and puller 209 is sufficiently larger than that of the lever 206 such that the force of gravity cause the lever 206 and shaft 208/puller 209 to be at rest as shown, i.e., with the lever 206 extending away from the grip body 202 to the maximum extent and the shaft 208 extending downward to the maximum extent. However, reliance of gravity in this way is not a requirement and a spring, e.g., disposed in the increased-diameter portion 504*a* between the grip body 202 and the puller 209, could be employed to bias the lever/puller shaft/puller assembly to the state illustrated in the Figures.

In use, the tool may be positioned above a deformation in the working surface 508 (and suitably mounted puller tab). Given the rotation of the feet 218, the working surface 508 need not be substantially flat and could instead include curves. Using the knob 501, the puller 509 can be adjusted so that it properly engages the puller tab. Thereafter, a user can grasp the tool 200 such that his/her palm engages the gripping surface 210 and fingers engage the lever 206. Once again, given the configuration of the lever 206 and gripping surface 210 on opposite sides of the puller shaft 208, the user able to grip the tool 200 without undesirable bending of the wrist. Thereafter, a squeezing force 530 on the lever 206 induces an upward linear force 540 in the puller shaft 208.

While particular preferred embodiments have been shown and described, those skilled in the art will appreciate that changes and modifications may be made without departing from the instant teachings. It is therefore contemplated that any and all modifications, variations or equivalents of the above-described teachings fall within the scope of the basic underlying principles disclosed above and claimed herein.

What is claimed is:

1. A dent puller comprising:

a base for supporting the dent puller on a working surface, the base defining a first bore;

a grip body cooperatively associated with the base, the grip body defining a gripping surface and a second bore;

a puller shaft extending within the first and second bores and substantially parallel to the gripping surface;

a lever cooperatively associated with the puller shaft and mounted for pivoting movement relative to the grip body, wherein the gripping surface and the lever extend on opposite sides of the puller shaft, and wherein the grip body and the lever are dimensioned, and the lever is mounted relative to the grip body, such that the lever and the gripping surface can be simultaneously grasped with a single hand when a squeezing force is applied to the lever.

2. The dent puller of claim 1, wherein the second bore extends parallel to a longitudinal axis of the grip body.

3. The dent puller of claim 1, wherein the grip body is mounted on the base such that a longitudinal axis of the grip body is substantially perpendicular to the base.

4. The dent puller of claim 1, wherein the grip body is mounted on the base for pivoting movement about the second bore.

5. The dent puller of claim 4, further comprising a set screw cooperatively associated with the base and configured to engage the grip body.

6. The dent puller of claim 1, further comprising:

a puller mounted on an end of the puller shaft opposite to engagement of the lever and the puller shaft.

7. The dent puller of claim 6, wherein the puller is mounted on the puller shaft via a threaded engagement.

8. The dent puller of claim 1, the lever further comprising an opening at an end thereof, wherein the puller shaft extends through the opening.

9. The dent puller of claim 1, wherein the lever is pivotally mounted on the grip body.

10. The dent puller of claim 1, wherein the base comprises a central member and at least one leg extending therefrom, wherein the central member defines the first bore.

11. The dent puller of claim 10, further comprising:

at least one foot cooperatively associated with a respective one of the at least one leg, each of the at least one foot configured to engage the working surface.

12. The dent puller of claim 11, wherein each of the at least one foot is mounted for pivoting movement relative to the respective one of the at least one leg.

13. The dent puller of claim 11, wherein each of the at least one foot comprises a compliant material defining a surface to engage the working surface.

* * * * *